US008648776B2

(12) United States Patent
Ohhashi

(10) Patent No.: US 8,648,776 B2
(45) Date of Patent: Feb. 11, 2014

(54) DISPLAY DEVICE, PIXEL CIRCUIT, AND METHOD FOR DRIVING SAME

(75) Inventor: Seiji Ohhashi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 549 days.

(21) Appl. No.: 12/937,890

(22) PCT Filed: Feb. 16, 2009

(86) PCT No.: PCT/JP2009/052477

§ 371 (c)(1),
(2), (4) Date: Oct. 14, 2010

(87) PCT Pub. No.: WO2009/142033

PCT Pub. Date: Nov. 26, 2009

(65) Prior Publication Data

US 2011/0037788 A1 Feb. 17, 2011

(30) Foreign Application Priority Data

May 20, 2008 (JP) ..... 2008-131568

(51) Int. Cl.
*G09G 3/30* (2006.01)

(52) U.S. Cl.
USPC ..... 345/76; 345/77

(58) Field of Classification Search
USPC ..... 345/76–83; 315/169.3
See application file for complete search history.

(56) References Cited

U.S. PATENT DOCUMENTS

2005/0237281 A1 10/2005 Tam (Continued)

FOREIGN PATENT DOCUMENTS

JP 2008-9080 1/2008

OTHER PUBLICATIONS

International Search Report for PCT/JP2009/052477, mailed Mar. 17, 2009.

(Continued)

*Primary Examiner* — Alexander Eisen
*Assistant Examiner* — Nelson Lam
(74) *Attorney, Agent, or Firm* — Nixon & Vanderhye P.C.

(57) ABSTRACT

A display device has a pixel circuit (100) including: a drive element (110) provided on a path connecting a first wiring line (Vp) to a second wiring line (Vcom), having a control terminal, a first terminal, and a second terminal, and controlling a current flowing through the path; an electro-optic element (130) provided in series with the drive element (110) on the path, being connected to the first terminal of the drive element (110), and emitting light at a luminance according to the current flowing through the path; a first switching element (111) provided between the first terminal of the drive element (110) and a data line (Sj); a second switching element (112) provided between the control terminal and the second terminal of the drive element (110); a third switching element (113) provided between the second terminal of the drive element (110) and the first wiring line (Vp); and a capacitor (121) provided between the control terminal of the drive element (110) and a third wiring line (Ui). In the display device, a potential at which a voltage applied to the electro-optic element (130) is a light-emission threshold voltage or less is provided to the data line (Sj), and a potential of the third wiring line (Ui) changes in two levels.

2 Claims, 5 Drawing Sheets

(56) References Cited

U.S. PATENT DOCUMENTS

| | | | | |
|---|---|---|---|---|
| 2005/0259051 | A1 | 11/2005 | Lee et al. | |
| 2006/0028409 | A1 | 2/2006 | Numao | |
| 2006/0214889 | A1* | 9/2006 | Matsumoto | 345/76 |
| 2007/0018917 | A1 | 1/2007 | Miyazawa | |
| 2007/0075937 | A1* | 4/2007 | Kim | 345/76 |
| 2008/0048955 | A1* | 2/2008 | Yumoto et al. | 345/82 |
| 2009/0167649 | A1* | 7/2009 | Ishizuka | 345/80 |
| 2009/0237378 | A1* | 9/2009 | Ohhashi et al. | 345/204 |
| 2010/0118059 | A1* | 5/2010 | Senda | 345/690 |
| 2011/0096059 | A1* | 4/2011 | Ohhashi | 345/212 |

OTHER PUBLICATIONS

Inukai, K. et al., "36.4L: Late-News Paper: 4.0-in. TFT-OLED Displays and a Novel Digital Driving Method", SID 00 DIGEST, pp. 924-927.

Takayama, T. et al., "Continuous Grain Silicon Technology and Its Applications for Active Matrix Display", AM-LCD, TFT1-1, (2000), pp. 25-28.

Friend, R.H., "Polymer Light-Emitting Diodes for use in Flat Panel Displays", AM-LCD '01, OLED-1, pp. 211-214.

Goh, J C et al., "A New a-Si:H Thin-Film Transistor Pixel Circuit for Active-Matrix Organic Light-Emitting Diodes", IEEE Electron Device Letters, vol. 24, No. 9, (Sep. 2003), pp. 583-585.

* cited by examiner

DISPLAY DEVICE, PIXEL CIRCUIT, AND METHOD FOR DRIVING SAME

This application is the U.S. national phase of International Application No. PCT/JP2009/052477 filed 16 Feb. 2009, which designated the U.S. and claims priority to JP Application No. 2008-131568 filed 20 May 2008, the entire contents of each of which are hereby incorporated by reference.

TECHNICAL FIELD

The present invention relates to a display device, and more particularly, to a current-driven type display device such as an organic EL display or an FED, pixel circuits of the display device, and a method for driving the pixel circuits.

BACKGROUND ART

In recent years, there has been an increasing demand for thin, lightweight, and fast response display devices. Correspondingly, research and development for organic EL (Electro Luminescence) displays and FEDs (Field Emission Displays) have been actively conducted.

Organic EL elements included in an organic EL display emit light at higher luminance for a higher voltage applied thereto and a larger amount of current flowing therethrough. However, the relationship between the luminance and voltage of the organic EL elements easily fluctuates by the influence of drive time, ambient temperature, etc. Hence, when a voltage control type drive scheme is applied to the organic EL display, it becomes very difficult to suppress variations in the luminance of the organic EL elements. On the other hand, the luminance of the organic EL elements is substantially proportional to current and this proportional relationship is less susceptible to external factors such as ambient temperature. Therefore, it is desirable to apply a current control type drive scheme to the organic EL display.

Meanwhile, pixel circuits and drive circuits of a display device are formed using TFTs (Thin Film Transistors) composed of amorphous silicon, low-temperature polycrystal silicon, CG (Continuous Grain) silicon, etc. However, variations easily occur in TFT characteristics (e.g., threshold voltage and mobility). In view of this, a circuit that compensates for variations in TFT characteristics is provided in a pixel circuit of an organic EL display, and by the action of this circuit variations in the luminance of an organic EL element are suppressed.

Schemes to compensate for variations in TFT characteristics in the current control type drive scheme are broadly classified into a current program scheme in which the amount of current flowing through a driving TFT is controlled by a current signal; and a voltage program scheme in which such an amount of current is controlled by a voltage signal. By using the current program scheme variations in threshold voltage and mobility can be compensated for, and by using the voltage program scheme only variations in threshold voltage can be compensated for.

However, the current program scheme has problems. Firstly, since a very small amount of current is handled, it is difficult to design pixel circuits and drive circuits. Secondly, since it is susceptible to parasitic capacitance while a current signal is set, it is difficult to achieve an increase in area. On the other hand, in the voltage program scheme, the influence of parasitic capacitance, etc., is very small and a circuit design is relatively easy. In addition, the influence exerted by variations in mobility on the amount of current is smaller than the influence exerted by variations in threshold voltage on the amount of current, and the variations in mobility can be suppressed to a certain extent in a TFT fabrication process. Accordingly, even in a display device to which the voltage program scheme is applied, sufficient display quality can be obtained.

For an organic EL display adopting the current control type drive method, various pixel circuits are conventionally known (e.g., Non-Patent Documents 1 to 4). FIG. 8 is a circuit diagram of a pixel circuit described in Non-Patent Document 4. A pixel circuit 900 shown in FIG. 8 includes a driving TFT 910, switching TFTs 911 to 913, a capacitor 921, and an organic EL element 930. All of the TFTs included in the pixel circuit 900 are of an n-channel type.

In the pixel circuit 900, the switching TFT 913, the driving TFT 910, and the organic EL element 930 are provided in series between a power supply wiring line Vp having a potential VDD and a cathode CTD of the organic EL element 930. The switching TFT 911 is provided between a source terminal of the driving TFT 910 and a data line Sj, the switching TFT 912 is provided between a gate terminal and a drain terminal of the driving TFT 910, and the capacitor 921 is provided between the gate terminal of the driving TFT 910 and the power supply wiring line Vp. Gate terminals of the respective switching TFTs 911 and 912 are connected to a control wiring line SLT, and a gate terminal of the switching TFT 913 is connected to a control wiring line TNO.

FIG. 9 is a timing chart of the pixel circuit 900. As shown in FIG. 9, first, at time t1, the potential of the control wiring line SLT is changed to a high level. Hence, the switching TFTs 911 and 912 are placed in a conducting state and thus a data potential Vda is applied to the source terminal of the driving TFT 910 from the data line Sj through the switching TFT 911. In addition, at time t1, the potential of the cathode CTD of the organic EL element 930 is also changed to a high level. Hence, a reverse bias voltage is applied between the anode and cathode of the organic EL element 930 and thus the organic EL element 930 is placed in a non-light emitting state. During a period from time t1 to time t2, since both the switching TFTs 912 and 913 are in a conducting state, the gate potential of the driving TFT 910 becomes equal to the potential VDD of the power supply wiring line Vp.

Then, at time t2, the potential of the control wiring line TNO is changed to a low level. Hence, the switching TFT 913 is placed in a non-conducting state and thus a current flows to the data line Sj from the gate terminal (and the drain terminal short-circuited thereto) of the driving TFT 910 through the driving TFT 910 and the switching TFT 911, and the gate potential of the driving TFT 910 gradually falls. When the voltage between the gate and source of the driving TFT 910 becomes equal to a threshold voltage Vth of the driving TFT 910 (i.e., when the gate potential reaches (Vda+Vth)), the driving TFT 910 is placed in a non-conducting state. At this point in time, the potential difference between the electrodes of the capacitor 921 reaches {Vp−(Vda+Vth)}. After this, the capacitor 921 holds this potential difference.

Then, at time t3, the potential of the control wiring line TNO is changed to a high level and the potential of the control wiring line SLT is changed to a low level. Hence, the switching TFTs 911 and 912 are placed in a non-conducting state and the switching TFT 913 is placed in a conducting state. Since the capacitor 921 holds the potential difference {Vp−(Vda+Vth)}, the gate potential of the driving TFT 910 remains at (Vda+Vth) even after time t3. In addition, at time t3, the potential of the cathode CTD of the organic EL element 930 is changed to a low level. Hence, a current according to a potential Vda (equal to a data potential) which is obtained by subtracting the threshold voltage Vth of the driving TFT 910 from the gate potential (Vda+Vth) of the driving TFT 910 flows to the organic EL element 930 from the driving TFT 910, and the organic EL element 930 emits light at a luminance according to the current.

As such, in the pixel circuit 900, the current flowing to the organic EL element 930 from the driving TFT 910 after time t3 is determined by the data potential Vda and thus is not influenced by the threshold voltage Vth of the driving TFT 910. Therefore, according to a display device including the pixel circuits 900, even when there are variations in the threshold voltage Vth of the driving TFT 910, by allowing a current according to the data potential Vda and the threshold voltage Vth to flow through the organic EL element 930, the organic EL element 930 can emit light at a desired luminance.

[Non-Patent Document 1] "4.0-in. TFT-OLED Displays and a Novel Digital Driving Method", SID'00 Digest, pp. 924-927, Semiconductor Energy Laboratory Co., Ltd.

[Non-Patent Document 2] "Continuous Grain Silicon Technology and Its Applications for Active Matrix Display", AM-LCD 2000, pp. 25-28, Semiconductor Energy Laboratory Co., Ltd.

[Non-Patent Document 3] "Polymer Light-Emitting Diodes for Use in Flat Panel Display", AM-LCD' 01, pp. 211-214, Semiconductor Energy Laboratory Co., Ltd.

[Non-Patent Document 4] "A new a-Si:H Thin-Film Transistor Pixel Circuit for Active-Matrix Organic Light-Emitting Diodes", Electron Device Letters, IEEE, Volume 24, Issue 9, pp. 583-585, Korea Advanced Institute of Science and Technology

DISCLOSURE OF THE INVENTION

Problems to be Solved by the Invention

As described above, in a display device including the pixel circuits 900, the potential of the cathode CTD of the organic EL element 930 needs to be brought to a high level during a period (a period from time t1 to time t3) during which the voltage between the gate and source of the driving TFT 910 is set to match the threshold voltage Vth of the driving TFT 910. General active matrix-type display devices include only one cathode which is common to all display elements. Hence, in the case of using the pixel circuits 900, too, a display device including only one cathode which is common to all organic EL elements 930 (hereinafter, referred to as the first display device) can be considered.

However, in the first display device, when a data potential Vda is written to a certain pixel circuit 900, a reverse bias voltage is applied to all of the organic EL elements 930 in the display device, and thus, all of the organic EL elements 930 do not emit light during this period. Due to this, in the first display device, a sufficient light-emission duty ratio cannot be obtained, causing a problem of degradation in display quality.

To solve this problem, a display device in which a cathode CTD of an organic EL element 930 is provided for each row of pixel circuits (a display device provided with cathodes CTD, the number of which is the same as that of control wiring lines SLT; hereinafter, referred to as the second display device) can be considered. However, to manufacture the second display device, when organic EL elements 930 are formed, cathodes CTD of the organic EL elements 930 need to be patterned. Hence, in the second display device, an extra process of fabricating the organic EL elements 930 is added, causing a problem of an increase in manufacturing cost. In addition, since the cathodes CTD of the organic EL elements 930 are patterned, there is another problem that the aperture ratio decreases, darkening a screen.

An object of the present invention is therefore to provide a low-cost display device with a high light-emission duty ratio and high display quality that does not require patterning of one side of the electrodes of electro-optic elements.

Means for Solving the Problems

According to a first aspect of the present invention, there is provided a current-driven type display device including: a plurality of pixel circuits arranged at respective intersections of a plurality of scanning lines and a plurality of data lines; a scanning signal output circuit that selects write-target pixel circuits using the scanning lines; and a display signal output circuit that provides potentials according to display data to the data lines, wherein each of the pixel circuits includes: a drive element provided on a path connecting a first wiring line to a second wiring line, having a control terminal, a first terminal, and a second terminal, and controlling a current flowing through the path; an electro-optic element provided in series with the drive element on the path, being connected to the first terminal of the drive element, and emitting light at a luminance according to the current flowing through the path; a first switching element provided between the first terminal of the drive element and the data line; a second switching element provided between the control terminal and the second terminal of the drive element; a third switching element provided between the second terminal of the drive element and the first wiring line; and a capacitor provided between the control terminal of the drive element and a third wiring line, wherein the display signal output circuit provides a potential at which a voltage applied to the electro-optic element is a light-emission threshold voltage or less, to the data line, and the scanning signal output circuit changes a potential of the third wiring lines in two levels.

According to a second aspect of the present invention, in the first aspect of the present invention, each of the pixel circuits further includes a fourth switching element provided between the control terminal of the drive element and a fourth wiring line.

According to a third aspect of the present invention, in the second aspect of the present invention, a control terminal of the fourth switching element is connected to the fourth wiring line.

According to a fourth aspect of the present invention, in the second aspect of the present invention, a potential that places the drive element in a conducting state is provided to the fourth wiring line.

According to a fifth aspect of the present invention, in the first aspect of the present invention, when a write is performed on the pixel circuit, the first and second switching elements are controlled to a conducting state, and the third switching element is controlled to a non-conducting state.

According to a sixth aspect of the present invention, in the first aspect of the present invention, the scanning signal output circuit has a function of adjusting timing at which the potential of the third wiring lines changes.

According to a seventh aspect of the present invention, in the first aspect of the present invention, the scanning signal output circuit has a function of adjusting timing at which a potential provided to a control terminal of the third switching element changes.

According to an eighth aspect of the present invention, in the first aspect of the present invention, the electro-optic element is composed of an organic EL element.

According to a ninth aspect of the present invention, there is provided a pixel circuit, a plurality of which are arranged on a current-driven type display device, at respective intersections of a plurality of scanning lines and a plurality of data lines, the pixel circuit including: a drive element provided on a path connecting a first wiring line to a second wiring line, having a control terminal, a first terminal, and a second terminal, and controlling a current flowing through the path; an electro-optic element provided in series with the drive element on the path, being connected to the first terminal of the drive element, and emitting light at a luminance according to the current flowing through the path; a first switching element provided between the first terminal of the drive element and the data line; a second switching element provided between the control terminal and the second terminal of the drive element; a third switching element provided between the second terminal of the drive element and the first wiring line; and a capacitor provided between the control terminal of the drive element and a third wiring line.

According to a tenth aspect of the present invention, in the ninth aspect of the present invention, the pixel circuit further includes a fourth switching element provided between the control terminal of the drive element and a fourth wiring line.

According to an eleventh aspect of the present invention, in the tenth aspect of the present invention, a control terminal of the fourth switching element is connected to the fourth wiring line.

According to a twelfth aspect of the present invention, there is provided a method for driving a pixel circuit, a plurality of which are arranged on a current-driven type display device, at respective intersections of a plurality of scanning lines and a plurality of data lines, the method including the steps of: when the pixel circuit includes: a drive element provided on a path connecting a first wiring line to a second wiring line, having a control terminal, a first terminal, and a second terminal, and controlling a current flowing through the path; an electro-optic element provided in series with the drive element on the path, being connected to the first terminal of the drive element, and emitting light at a luminance according to the current flowing through the path; a first switching element provided between the first terminal of the drive element and the data line; a second switching element provided between the control terminal and the second terminal of the drive element; a third switching element provided between the second terminal of the drive element and the first wiring line; and a capacitor provided between the control terminal of the drive element and a third wiring line, controlling the first and second switching elements to a conducting state and the third switching element to a non-conducting state, and providing a potential which changes according to display data and at which a voltage applied to the electro-optic element is a light-emission threshold voltage or less, to the data line; changing a potential of the third wiring line in two levels; and controlling the first and second switching elements to a non-conducting state and the third switching element to a conducting state.

According to a thirteenth aspect of the present invention, in the twelfth aspect of the present invention, the method for driving a pixel circuit further includes the step of: when the pixel circuit further includes a fourth switching element provided between the control terminal of the drive element and a fourth wiring line, controlling the fourth switching element to a conducting state while the first and second switching elements are in a conducting state and the third switching element is in a non-conducting state, with a potential that places the drive element in a conducting state being provided to the fourth wiring line.

Effect of the Invention

According to the first aspect of the present invention, since a potential at which a voltage applied to an electro-optic element is a light-emission threshold voltage or less is provided to a data line, the electro-optic element does not emit light only by writing the potential of the data line to a pixel circuit, but after a potential of a third wiring line is changed, the electro-optic element emits light. In addition, by controlling a second switching element to a conducting state and a third switching element to a non-conducting state, a threshold voltage can be applied between a control terminal and a first terminal of a drive element. Thereafter, by changing the potential of the third wiring line, the electro-optic element can emit light at a desired luminance, regardless of the threshold voltage of the drive element. As such, while variations in the threshold voltage of the drive element are compensated for, when a potential according to display data is written to the pixel circuit, the electro-optic element can be placed in a non-light emitting state, with a potential of a second wiring line being fixed. Hence, even while a write is performed on a certain pixel circuit, electro-optic elements in other pixel circuits continue to emit light. Thus, compared to the case in which, while a write is performed on a certain pixel circuit, electro-optic elements in other pixel circuits do not emit light, the light-emission duty ratio is higher and the display quality is also higher. In addition, since the potential of the second wiring line does not need to be controlled in a divisional manner, there is no need to pattern the electrodes of the electro-optic elements (the electrodes on the second wiring line side) and correspondingly the cost of the display device is reduced. In addition, a scanning signal output circuit that changes the potential of the third wiring line in two levels can be formed easily. Accordingly, a low-cost display device with a high light-emission duty ratio and high display quality that does not require patterning of one side of the electrodes of electro-optic elements can be obtained.

According to the second aspect of the present invention, by applying a suitable potential to a fourth wiring line and controlling a fourth switching element to a conducting state, a threshold voltage can be applied between the control terminal and first terminal of the drive element, without applying a potential of a first wiring line to the control terminal of the drive element. By this, power consumption of the display device can be reduced.

According to the third aspect of the present invention, by connecting a control terminal of the fourth switching element to the same wiring line as another terminal thereof, the number of wiring lines is reduced by one, and the aperture ratio and yield of the display device can be increased.

According to the fourth aspect of the present invention, by providing a potential that places the drive element in a conducting state to the fourth wiring line, the time required to apply a threshold voltage between the control terminal and first terminal of the drive element can be reduced. By this, a display device with high resolution can be configured.

According to the fifth aspect of the present invention, by controlling the second switching element to a conducting state and the third switching element to a non-conducting state, a threshold voltage can be applied between the control terminal and first terminal of the drive element. Thereafter, by providing a potential that places the drive element in a conducting state to the third wiring line, the electro-optic element can emit light at a desired luminance, regardless of the threshold voltage of the drive element.

According to the sixth aspect of the present invention, by the scanning signal output circuit adjusting the timing at which the potential of the third wiring line changes, the light-emission duty ratio is adjusted, and moving-image blur which is a drawback of display devices performing hold-type display can be solved.

According to the seventh aspect of the present invention, by the scanning signal output circuit adjusting the timing at which a potential provided to the control terminal of the third switching element changes, the light-emission duty ratio is adjusted, and moving-image blur which is a drawback of display devices performing hold-type display can be solved.

According to the eighth aspect of the present invention, a low-cost organic EL display with a high light-emission duty ratio and high display quality that does not require patterning of cathodes of organic EL elements can be configured.

According to the ninth to eleventh aspects of the present invention, pixel circuits included in the display devices according to the first to third aspects of the present invention are formed. By using the pixel circuits, a low-cost display device with a high light-emission duty ratio and high display quality that does not require patterning of one side of the electrodes of electro-optic elements can be obtained.

According to the twelfth aspect of the present invention, for the same reasons as those in the first aspect of the present invention, in a low-cost display device in which patterning of one side of the electrodes of electro-optic elements is not performed, the light-emission duty ratio can be increased and the display quality can be improved.

According to the thirteenth aspect of the present invention, by providing a potential that places the drive element in a conducting state to the fourth wiring line and controlling the fourth switching element to a conducting state, a threshold voltage can be applied between the control terminal and first terminal of the drive element in a short time, without applying a potential of the first wiring line to the control terminal of the drive element. By this, power consumption of the display device can be reduced and a display device with high resolution can be configured.

DESCRIPTION OF THE REFERENCE NUMERALS

10 DISPLAY DEVICE
11 DISPLAY CONTROL CIRCUIT
12 GATE DRIVER CIRCUIT
13 SOURCE DRIVER CIRCUIT
21 SHIFT REGISTER
22 REGISTER
23 LATCH CIRCUIT
24 D/A CONVERTER
100, 200, and 250 PIXEL CIRCUIT
110 DRIVING TFT
111, 112, 113, and 214 SWITCHING TFT
121 CAPACITOR
130 ORGANIC EL ELEMENT
Gi SCANNING LINE
Ri, Ui, and Wi CONTROL WIRING LINE
Sj DATA LINE
Vp and Vref POWER SUPPLY WIRING LINE
Vcom COMMON CATHODE

BEST MODE FOR CARRYING OUT THE INVENTION

Display devices according to first and second embodiments of the present invention will be described below with reference to FIGS. 1 to 7. The display devices according to the embodiments include pixel circuits, each including an electro-optic element, a drive element, a capacitor, and a plurality of switching elements. The switching elements can be composed of low-temperature polysilicon TFTs, CG silicon TFTs, amorphous silicon TFTs, etc. The configurations and fabrication processes of these TFTs are known and thus description thereof is omitted here. For the electro-optic element, an organic EL element is used. The configuration of the organic EL element is also known and thus description thereof is omitted here.

Figure 1:
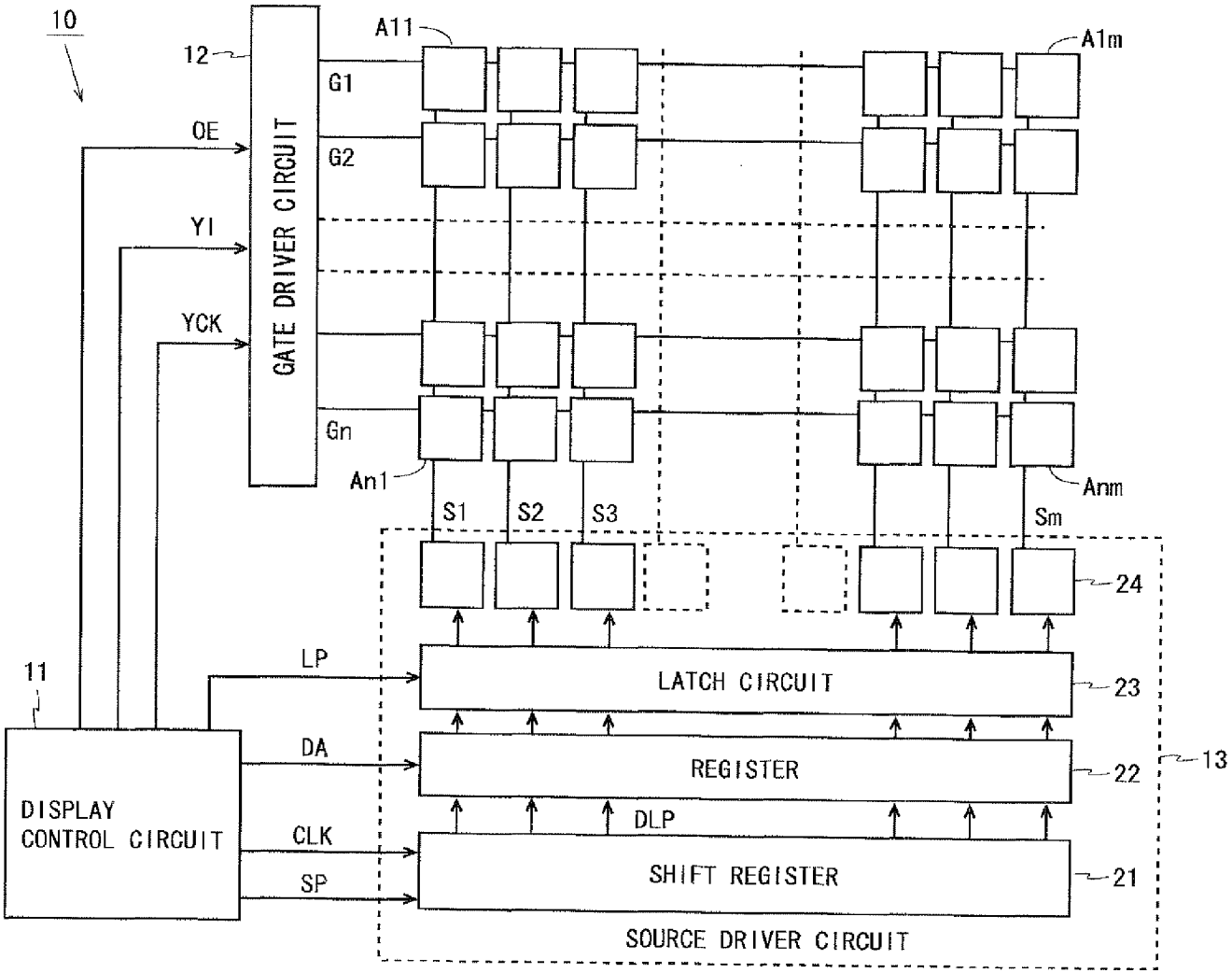
FIG. 1 is a block diagram showing a configuration of display devices according to first and second embodiments of the present invention.

FIG. 1 is a block diagram showing a configuration of display devices according to the first and second embodiments of the present invention. A display device 10 shown in FIG. 1 includes a plurality of pixel circuits Aij (i is an integer between 1 and n inclusive and j is an integer between 1 and m inclusive), a display control circuit 11, a gate driver circuit 12, and a source driver circuit 13. In the display device 10, a plurality of scanning lines Gi arranged parallel to one another and a plurality of data lines Sj arranged parallel to one another to vertically intersect the scanning lines Gi are provided. The pixel circuits Aij are arranged in a matrix form at respective intersections of the scanning lines Gi and the data lines Sj.

In addition to them, in the display device 10, a plurality of control wiring lines (Ri, Ui, Wi, etc.; not shown) are arranged parallel to the scanning lines Gi. In addition, though not shown in FIG. 1, in a region where the pixel circuits Aij are arranged, a power supply wiring line Vp and a common cathode Vcom are arranged, and in some embodiments a power supply wiring line Vref may be arranged. The scanning lines Gi and the control wiring lines are connected to the gate driver circuit 12 and the data lines Sj are connected to the source driver circuit 13.

The display control circuit 11 outputs a timing signal OE, a start pulse YI, and a clock YCK to the gate driver circuit 12 and outputs a start pulse SP, a clock CLK, display data DA, and a latch pulse LP to the source driver circuit 13.

The gate driver circuit 12 includes a shift register circuit, a logic operation circuit, and buffers (none of which are shown). The shift register circuit sequentially transfers the start pulse YI in synchronization with the clock YCK. The logic operation circuit performs a logic operation between a pulse outputted from each stage of the shift register circuit and the timing signal OE. Outputs from the logic operation circuit are provided to corresponding scanning lines Gi and control wiring lines through the buffers. As such, the gate driver circuit 12 functions as a scanning signal output circuit that selects write-target pixel circuits using scanning lines Gi.

The source driver circuit 13 includes an m-bit shift register 21, a register 22, a latch circuit 23, and m D/A converters 24. The shift register 21 includes m cascade-connected one-bit registers. The shift register 21 sequentially transfers the start pulse SP in synchronization with the clock CLK and outputs timing pulses DLP from the registers of the respective stages. The display data DA is supplied to the register 22 in accordance with output timing of the timing pulses DLP. The register 22 stores the display data DA according to the timing pulses DLP. When the display data DA corresponding to one row is stored in the register 22, the display control circuit 11 outputs the latch pulse LP to the latch circuit 23. When the latch circuit 23 receives the latch pulse LP, the latch circuit 23 holds the display data stored in the register 22. The D/A converters 24 are provided to the respective data lines Sj on a one-to-one basis. The D/A converters 24 convert the display data held in the latch circuit 23 into analog signal voltages and provide the analog signal voltages to the corresponding data lines Sj. As such, the source driver circuit 13 functions as a display signal output circuit that provides potentials according to display data to the data lines Sj.

Note that although here the source driver circuit 13 performs line sequential scanning where potentials according to display data corresponding to one row are simultaneously supplied to pixel circuits connected to one scanning line, instead of this, dot sequential scanning where a potential according to display data is supplied to each pixel circuit in turn may be performed. The configuration of a source driver circuit that performs dot sequential scanning is known and thus description thereof is omitted here.

The pixel circuits Aij included in a display device according to each of the embodiments will be described in detail below. A driving TFT, switching TFTs, and an organic EL element included in each pixel circuit Aij function as a drive element, switching elements, and an electro-optic element, respectively. The power supply wiring line Vp corresponds to a first wiring line and the common cathode Vcom corresponds to a second wiring line.

First Embodiment

Figure 2:
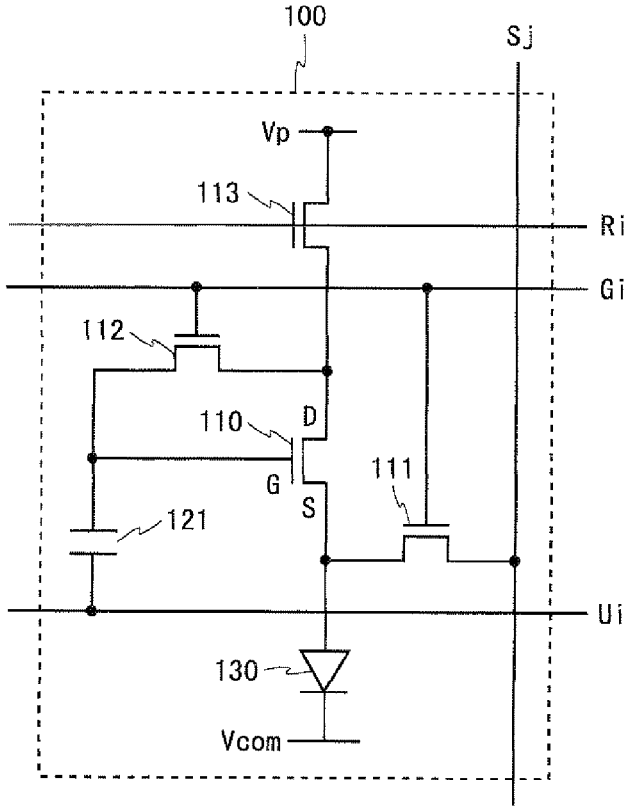
FIG. 2 is a circuit diagram of a pixel circuit included in a display device according to the first embodiment of the present invention.

FIG. 2 is a circuit diagram of a pixel circuit included in a display device according to the first embodiment of the present invention. A pixel circuit 100 shown in FIG. 2 includes a driving TFT 110, switching TFTs 111 to 113, a capacitor 121, and an organic EL element 130. All of the TFTs included in the pixel circuit 100 are of an n-channel type.

The pixel circuit 100 is connected to a power supply wiring line Vp, a common cathode Vcom, a scanning line Gi, control wiring lines Ri and Ui, and a data line Sj. Of them, to the power supply wiring line Vp and the common cathode Vcom are respectively applied fixed potentials VDD and VSS (note that VDD>VSS). The common cathode Vcom is a cathode common to all organic EL elements 130 in the display device.

Terminals of the driving TFT 110 denoted as G, S, and D in FIG. 2 are referred to as a gate terminal, a source terminal, and a drain terminal, respectively. In general, in an n-channel type TFT, of the two current input and output terminals, the one with a lower applied voltage is referred to as a source terminal and the one with a higher applied voltage is referred to as a drain terminal. In a p-channel type TFT, of the two current input and output terminals, the one with a lower applied voltage is referred to as a drain terminal and the one with a higher applied voltage is referred to as a source terminal. However, since changing the names of terminals according to the voltage magnitude relationship makes description complicated, even when the voltage magnitude relationship is reversed and thus the two current input and output terminals should be called with the swapped names, the two terminals are called with the shown names for the sake of convenience. Although in the present embodiment an n-channel type is used for all of the TFTs, a p-channel type may be used for the switching TFTs. In this case, a low-level potential corresponds to a conducting state and a high-level potential corresponds to a non-conducting state, and the potential for the conducting state and the potential for the non-conducting state are opposite to those for the case in which an non-channel type is used for the switching TFTs. The above-described points also apply to the second embodiment.

In the pixel circuit 100, the switching TFT 113, the driving TFT 110, and the organic EL element 130 are provided in series on a path connecting the power supply wiring line Vp to the common cathode Vcom, in order from the side of the power supply wiring line Vp. The switching TFT 111 is provided between the source terminal of the driving TFT 110 and the data line Sj. The switching TFT 112 is provided between the gate terminal and drain terminal of the driving TFT 110. The capacitor 121 is provided between the gate terminal of the driving TFT 110 and the control wiring line Ui. Gate terminals of the respective switching TFTs 111 and 112 are both connected to the scanning line Gi, and the gate terminal of the switching TFT 113 is connected to the control wiring line Ri. The operation of the pixel circuit 100 is controlled by the gate driver circuit 12 and the source driver circuit 13 which operate based on signals supplied thereto from the display control circuit 11.

Figure 3:
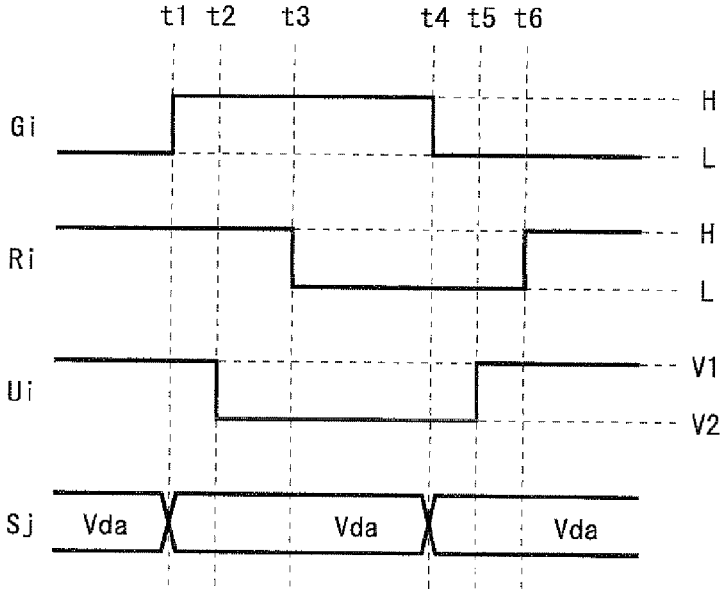
FIG. 3 is a timing chart of the pixel circuit shown in FIG. 2.

FIG. 3 is a timing chart of the pixel circuit 100. FIG. 3 shows changes in the potentials of the scanning line Gi, the control wiring lines Ri and Ui, and the data line Sj. Note that the reason that in the following description the organic EL element 130 is controlled to a non-light emitting state during a period during which the voltage of the scanning line Gi is at a high level is that if the organic EL element 130 emits light during this period, the luminance when black display is performed increases correspondingly, which decreases the contrast of a screen.

Before time t1, the potential of the scanning line Gi is controlled to a low level, the potential of the control wiring line Ri is controlled to a high level, and the potential of the control wiring line Ui is controlled to a relatively high potential V1. Hence, the switching TFTs 111 and 112 are in a non-conducting state and the switching TFT 113 is in a conducting state. At this time, since the driving TFT 110 is in a conducting state, a current flows to the organic EL element 130 from the power supply wiring line Vp through the switching TFT 113 and the driving TFT 110, and the organic EL element 130 emits light at a predetermined luminance.

Then, at time t1, the potential of the scanning line Gi is changed to a high level and a new data potential Vda is applied to the data line Sj. Hence, the switching TFTs 111 and 112 are placed in a conducting state and thus the data potential Vda is applied to the source terminal of the driving TFT 110 from the data line Sj through the switching TFT 111.

Note that the data potential Vda applied at this time is determined such that the organic EL element 130 is placed in a non-light emitting state. Specifically, when the potential of the common cathode Vcom is VSS and the light-emission threshold voltage of the organic EL element 130 is Vth_oled, the data potential Vda is determined such that the difference between the data potential Vda and the potential VSS is the light-emission threshold voltage Vth_oled or less. This is represented by the following equation (1):

$$Vth_oled \geq Vda - VSS \quad (1).$$

In addition, since the switching TFT 112 is in a conducting state, the gate and drain of the driving TFT 110 are short-circuited and thus a potential VDD is applied to the gate terminal and drain terminal of the driving TFT 110 from the power supply wiring line Vp. Therefore, the voltage Vgs between the gate and the source of the driving TFT 110 is as shown in the following equation (2):

$$Vgs=VDD-Vda \quad (2).$$

Then, at time t2, the potential of the control wiring line Ui is changed to a relatively low potential V2. Then, at time t3, the potential of the control wiring line Ri is changed to a low level. Hence, the switching TFT 113 is placed in a non-conducting state and thus a current flows to the source terminal of the driving TFT 110 from the gate terminal (and the drain terminal short-circuited thereto) of the driving TFT 110 and the gate potential of the driving TFT 110 gradually falls. When the voltage between the gate and the source of the driving TFT 110 becomes equal to a threshold voltage Vth of the driving TFT 110 (i.e., when the gate potential reaches (Vda+Vth)), the driving TFT 110 is placed in a non-conducting state and thus the gate potential of the driving TFT 110 does not fall thereafter. At this point in time, the driving TFT 110 is placed in a state in which the threshold voltage Vth is being applied between the gate and the source, regardless of the threshold voltage Vth. In addition, a potential difference between electrodes of the capacitor 121 reaches (Vda+Vth−V2). After this, the capacitor 121 holds this potential difference.

Then, at time t4, the potential of the scanning line Gi is changed to a low level. Hence, the switching TFTs 111 and 112 are placed in a non-conducting state. Then, at time t5, the potential of the control wiring line Ui is changed from V2 to V1. Since the control wiring line Ui and the gate terminal of the driving TFT 110 are connected to each other through the capacitor 121, when the potential of the control wiring line Ui is changed, the gate potential of the driving TFT 110 changes by the same amount (V1−V2). Thus, the gate potential Vg of the driving TFT 110 is as shown in the following equation (3):

$$Vg=Vda+Vth+V1-V2 \quad (3).$$

Finally, at time t6, the potential of the control wiring line Ri is changed to a high level. Hence, the switching TFT 113 is placed in a conducting state and thus a potential VDD is applied to the drain terminal of the driving TFT 110 from the power supply wiring line Vp. In addition, since the capacitor 121 holds the potential difference (Vda+Vth−V2), the gate potential of the driving TFT 110 remains at (Vda+Vth+V1−V2) even after time t6. Hence, a current according to a voltage (Vda+V1−V2) which is obtained by subtracting the threshold voltage Vth of the driving TFT 110 from the gate potential (Vda+Vth+V1−V2) of the driving TFT 110 flows to the common cathode Vcom from the power supply wiring line Vp, and the organic EL element 130 emits light at a luminance according to the current.

Hence, the data potential Vda applied to the data line Sj during a period (from time t1 to time t4) during which the potential of the scanning line Gi is at a high level is set to a potential that is obtained by subtracting an amplitude of the potential of the control wiring line Ui (V1−V2) from a data potential Vda' to be originally applied to allow the organic EL element 130 to emit light at a desired luminance. This is represented by the following equation (4):

$$Vda=Vda'-(V1-V2) \quad (4).$$

By applying the data potential Vda determined by equation (4) to the data line Sj and changing the potential of the control wiring line Ui by (V1−V2), the organic EL element 130 can emit light at a desired luminance while variations in the threshold voltage Vth of the driving TFT 110 are compensated for.

Figure 4:
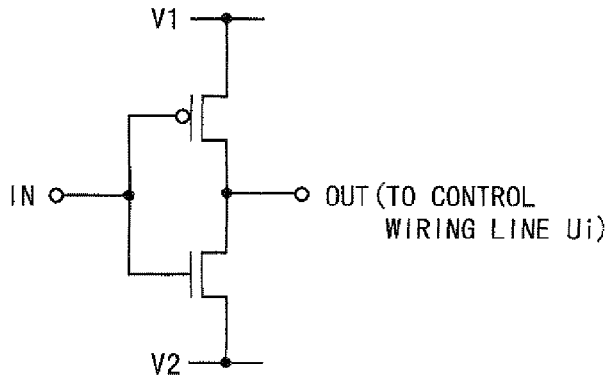
FIG. 4 is a circuit diagram of an inverter.

As shown in FIG. 3, the gate driver circuit 12 changes the potential of the control wiring line Ui in two levels (V1 and V2). Hence, an inverter circuit shown in FIG. 4 is provided at the last stage of the gate driver circuit 12, as a buffer circuit. The inverter circuit shown in FIG. 4 changes the potential of the control wiring line Ui in two levels, according to an input signal IN.

To change the potential of the control wiring line Ui in three or more levels, a more complex circuit than that in FIG. 4 is required, increasing the area of the driver circuit. Due to this, when the driver circuit is formed on a glass substrate, there are problems of an increase in the size of an outer frame and a reduction in yield, and when the driver circuit is included in an IC, there are problems of an increase in cost and a reduction in yield which are caused by an increase in chip area, and an increase in power consumption caused by the complexity of the circuit. The display device according to the present embodiment includes the gate driver circuit 12 that changes the potential of the control wiring line Ui in two levels. Such a gate driver circuit can be formed easily.

As described above, the display device according to the present embodiment includes a plurality of pixel circuits 100, the gate driver circuit 12, and the source driver circuit 13. Each pixel circuit 100 includes a driving TFT 110, switching TFTs 111 to 113, a capacitor 121, and an organic EL element 130. The source driver circuit 13 provides, to the data line Sj, a potential at which a voltage applied to the organic EL element 130 is the light-emission threshold voltage Vth_oled or less. The gate driver circuit 12 changes the potential of the control wiring line Ui in two levels (V1 and V2).

As such, since a potential at which a voltage applied to the organic EL element 130 is the light-emission threshold voltage Vth_oled or less is provided to each data line Sj, the organic EL element 130 does not emit light only by writing the potential of the data line Sj to the pixel circuit 100, but after the potential of the control wiring line Ui is changed to V1 the organic EL element 130 emits light. By controlling the switching TFT 112 to a conducting state and controlling the switching TFT 113 to a non-conducting state, a threshold voltage Vth can be applied between the gate and the source of the driving TFT 110. In that state, by applying a potential that places the driving TFT 110 in a conducting state to the control wiring line Ui, the driving TFT 110 can emit light at a desired luminance, regardless of the threshold voltage Vth of the driving TFT 110. As such, while variations in the threshold voltage Vth of the driving TFT 110 are compensated for, when a data potential Vda is written to the pixel circuit 100, the organic EL element 130 can be placed in a non-light emitting state, with the potential of the common cathode Vcom being fixed.

Hence, even while a write is performed on a certain pixel circuit 100, organic EL elements 130 in other pixel circuits 100 continue to emit light. Thus, compared to a display device in which, while a write is performed on a certain pixel circuit, organic EL elements in other pixel circuits do not emit light, the light-emission duty ratio is higher and the display quality is also higher. In addition, since the potential of the common cathode Vcom does not need to be controlled in a divisional manner, there is no need to pattern the cathodes of the organic EL elements 130 and correspondingly the cost of the display device is reduced. In addition, the gate driver circuit 12 that changes the potential of the control wiring lines Ui in two levels can be formed easily. Accordingly, a low-cost display device (organic EL display) with a high light-emission duty ratio and high display quality that does not require patterning of the cathodes of the organic EL elements 130 can be obtained.

In addition, by configuring the driving TFT 110 and all of the switching elements (switching TFTs 111 to 113) in the pixel circuit 100 by TFTs, a high-performance display device can be manufactured easily. In particular, by configuring the driving TFT 110 and all of the switching elements in the pixel circuit 100 by n-channel type transistors, all of the transistors are fabricated by the same process with use of the same mask, enabling the cost reduction of the display device. In addition, since transistors of the same channel type can be arranged closer to each other than transistors of different channel types, more transistors can be arranged in the same area.

Note that, for the display device according to the present embodiment, various variants can be formed. For example, although in the pixel circuit 100 the gate terminals of the switching TFTs 111 and 112 are connected to the same wiring line (scanning line Gi), the gate terminals of the switching TFTs 111 and 112 may be connected to different control wiring lines and the potentials of the two control wiring lines may be changed at substantially the same timing (first variant).

A current having flown to the source terminal of the driving TFT 110 during a period from time t1 to time t4 (a period during which the switching TFT 111 is in a conducting state) flows to the organic EL element 130 and the switching TFT 111, according to the resistance component of the organic EL element 130 and the resistance component of the switching TFT 111 in a conducting state. In general, the larger the amount of current flowing through an organic EL element, the shorter the life of the organic EL element. Hence, to prevent a current from flowing through the organic EL element 130, the data potential Vda may be set to the potential VSS of the common cathode Vcom or less (second variant). This is represented by the following equation (5):

$$Vda \leq VSS \quad (5).$$

When a data potential Vda that satisfies equation (5) is used, the anode and the cathode of the organic EL element 130 reach the same potential or a reverse bias voltage is applied to the organic EL element 130. Accordingly, a current is prevented from flowing through the organic EL element 130 during a period from time t1 to time t4 (a period during which the switching TFT 111 is in a conducting state), enabling to prolong the life of the organic EL element 130.

Although, in FIG. 3, the potential of the control wiring line Ui is lowered (changed from V1 to V2) after the potential of the scanning line Gi is changed to a high level, the potential of the control wiring line Ui may be lowered before the potential of the scanning line Gi is changed to a high level (third variant). According to this method, even when there is a large number of scanning lines Gi and the period of time during which the potentials of the scanning lines Gi are at a high level is short, variations in the threshold voltage Vth of the driving TFT 110 can be compensated for. Note, however, that, when this method is used, a forward bias voltage is applied to the organic EL element 130 and thus the organic EL element 130 unnecessarily emits light, which may reduce the contrast of a screen. Therefore, it is more preferable that, as shown in FIG. 3, the potential of the control wiring line Ui be lowered after the potential of the scanning line Gi is changed to a high level.

The function of adjusting the timing at which the potential of the control wiring line Ui is raised (time t5 in FIG. 3) may be provided to the gate driver circuit 12 (fourth variant). By thus adjusting the timing at which the potential of the control wiring line Ui changes, the length of the light emission period of the organic EL element 130 is adjusted and thus the light-emission duty ratio of the organic EL element 130 can be adjusted. Therefore, moving-image blur which is a drawback of display devices performing a hold-type display, such as organic EL displays, can be solved.

The function of adjusting the timing at which the potential of the control wiring line Ri is brought to a high level (time t6 in FIG. 3) may be provided to the gate driver circuit 12 (fifth variant). By thus adjusting the timing at which the potential of the control wiring line Ri changes, the length of the light emission period of the organic EL element 130 is adjusted and thus the light-emission duty ratio of the organic EL element 130 can be adjusted. Accordingly, the same effect as that obtained by a display device according to the fourth variant can be obtained.

Second Embodiment

Figure 5:
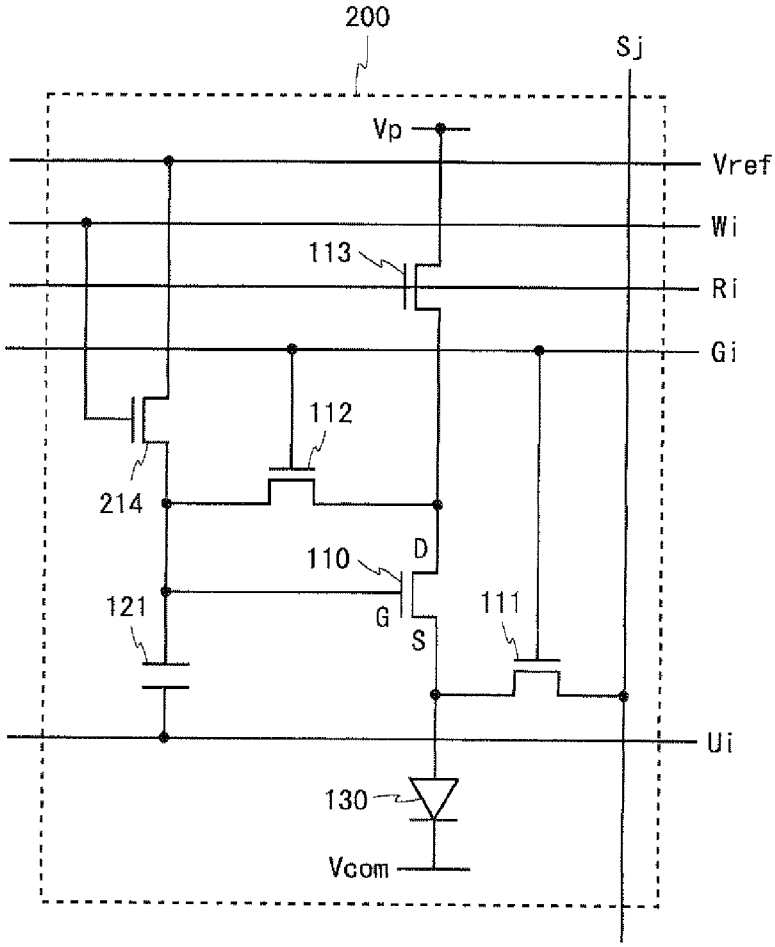
FIG. 5 is a circuit diagram of a pixel circuit included in a display device according to the second embodiment of the present invention.

FIG. 5 is a circuit diagram of a pixel circuit included in a display device according to the second embodiment of the present invention. A pixel circuit 200 shown in FIG. 5 includes a driving TFT 110, switching TFTs 111 to 113 and 214, a capacitor 121, and an organic EL element 130. All of the TFTs included in the pixel circuit 200 are of an n-channel type. Of the components in the present embodiment, the same components as those in the first embodiment are denoted by the same reference numerals and description thereof is omitted.

The pixel circuit 200 is obtained by making changes to the pixel circuit 100 according to the first embodiment such that a power supply wiring line Vref and a control wiring line Wi are added, the switching TFT 214 is provided between the power supply wiring line Vref and a gate terminal of the driving TFT 110, and a gate terminal of the switching TFT 214 is connected to the control wiring line Wi. A fixed initial potential Vini is applied to the power supply wiring line Vref.

Figure 6:
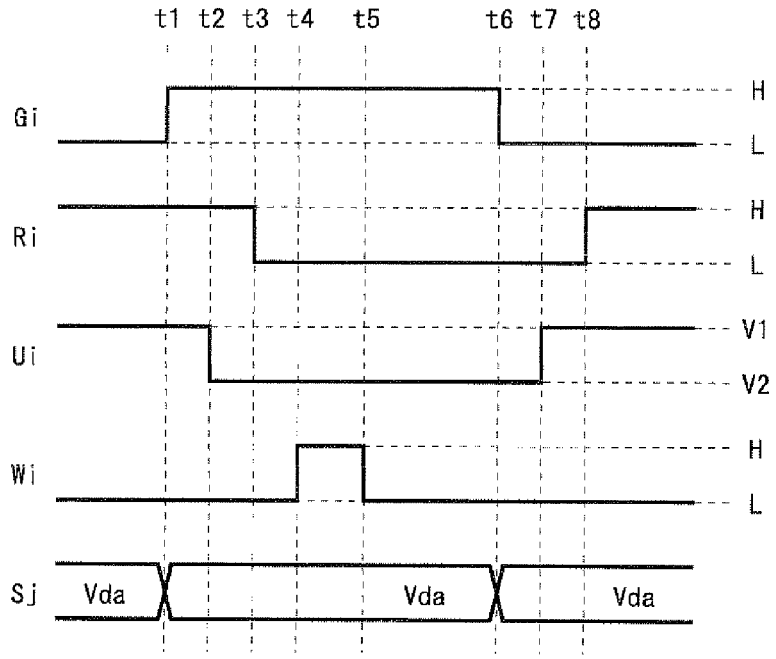
FIG. 6 is a timing chart of the pixel circuit shown in FIG. 5.

FIG. 6 is a timing chart of the pixel circuit 200. FIG. 6 shows changes in the potentials of a scanning line Gi, control wiring lines Ri, Ui, and Wi, and a data line Sj. Before time t4, the potential of the control wiring line Wi is controlled to a low level. Hence, the switching TFT 214 is in a non-conducting state and the pixel circuit 200 operates in the same manner as the pixel circuit 100. Note, however, that although in the pixel circuit 100 a threshold voltage Vth needs to be applied between the gate and the source of the driving TFT 110 during a period from time t3 to time t4, the pixel circuit 200 does not require such a voltage application.

Then, at time t4, the potential of the control wiring line Wi is changed to a high level. Hence, the switching TFT 214 is placed in a conducting state and an initial potential Vini is applied to the gate terminal and the drain terminal of the driving TFT 110 from the power supply wiring line Vref through the switching TFT 214. Note that the initial potential Vini is determined such that the driving TFT 110 is placed in a conducting state. Specifically, the initial potential Vini is determined such that in all pixel circuits 200 the difference between the initial potential Vini and the source potential Vda of the driving TFT 110 is the threshold voltage Vth of the driving TFT 110 or more. This is represented by the following equation (6):

$$Vth \leq Vini - (\text{maximum value of } Vda) \quad (6)$$

Then, at time t5, the potential of the control wiring line Wi is changed to a low level. Hence, the switching TFT 214 is placed in a non-conducting state and thus a current flows to the source terminal of the driving TFT 110 from the gate terminal (and the drain terminal short-circuited thereto) of the driving TFT 110 and the gate potential of the driving TFT 110 gradually falls. When the voltage between the gate and the source of the driving TFT 110 becomes equal to the threshold voltage Vth of the driving TFT 110, the driving TFT 110 is placed in a non-conducting state and thus the gate potential of the driving TFT 110 does not fall thereafter. At this point in time, the driving TFT 110 is placed in a state in which the threshold voltage Vth is being applied between the gate and the source, regardless of the threshold voltage Vth. In addition, the potential difference between the electrodes of the capacitor 121 reaches (Vda+Vth−V2). After this, the capacitor 121 holds this potential difference. After time t6, the pixel circuit 200 operates in the same manner as after time t4 for the pixel circuit 100.

As described above, the pixel circuit 200 includes the switching TFT 214 between the gate terminal of the driving TFT 110 and the power supply wiring line Vref, and a potential that places the driving TFT 110 in a conducting state is provided to the power supply wiring line Vref. Therefore, by controlling the switching TFT 214 to a conducting state, a threshold voltage Vth can be applied between the gate and the source of the driving TFT 110, without applying a potential VDD of the power supply wiring line Vp to the gate terminal of the driving TFT 110. Thus, according to the display device according to the present embodiment, power consumption can be reduced. In addition, by providing a potential that places the driving TFT 110 in a conducting state to the power supply wiring line Vref, the time required to apply a threshold voltage Vth between the gate and the source of the driving TFT 110 is reduced, enabling the configuration of a display device with high resolution.

Note that, for display devices of the present invention, various variants can be formed. For example, in the display device according to the second embodiment, too, as with the first embodiment, the first to fifth variants may be formed.

Figure 7:
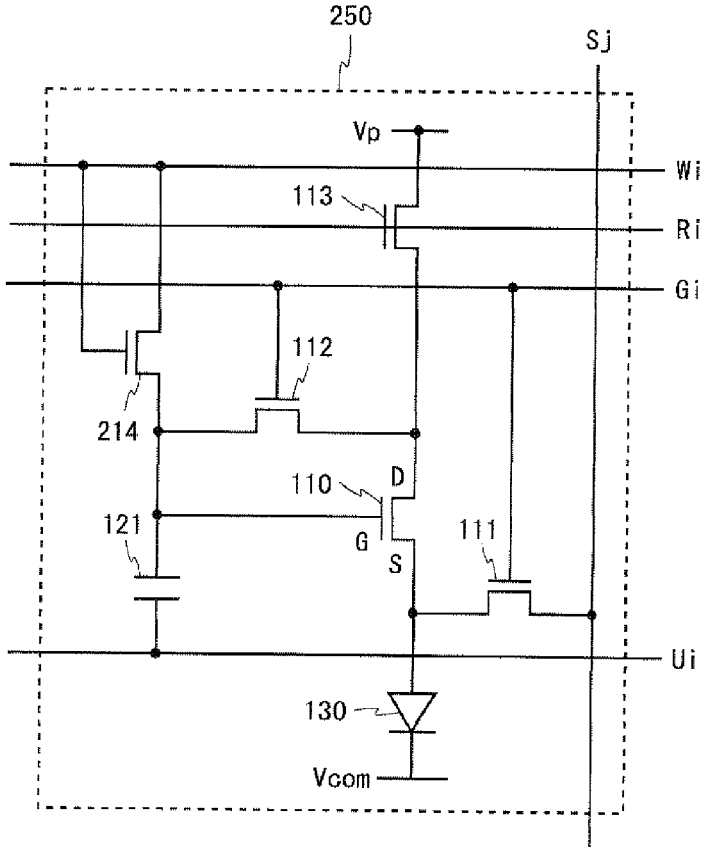
FIG. 7 is a circuit diagram of a pixel circuit included in a display device according to a variant of the present invention.
Figure 8:
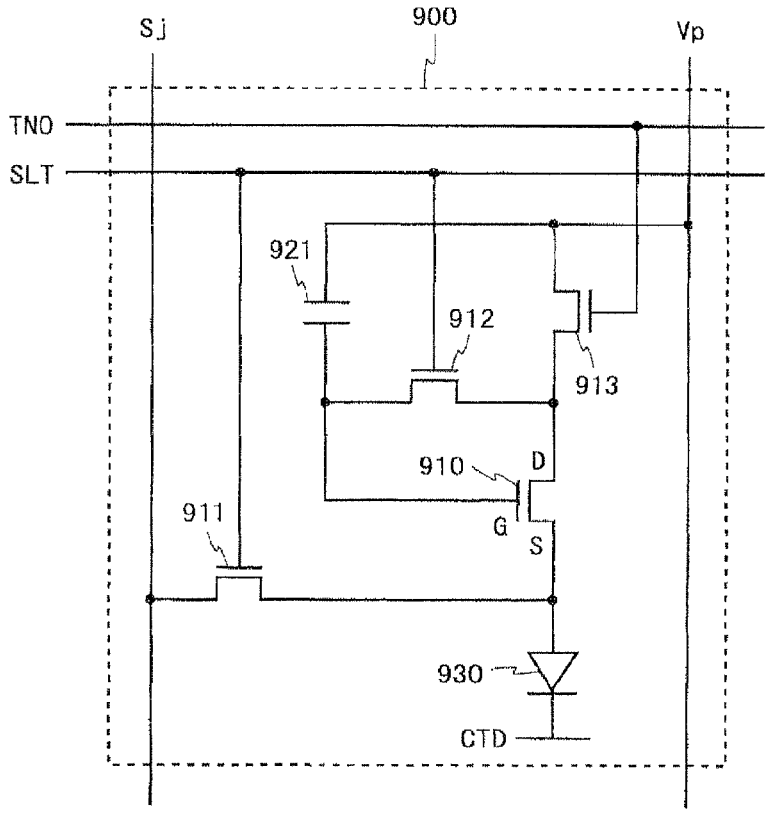
Fig. 8 Prior Art
FIG. 8 is a circuit diagram of a pixel circuit included in a conventional display device.
Figure 9:
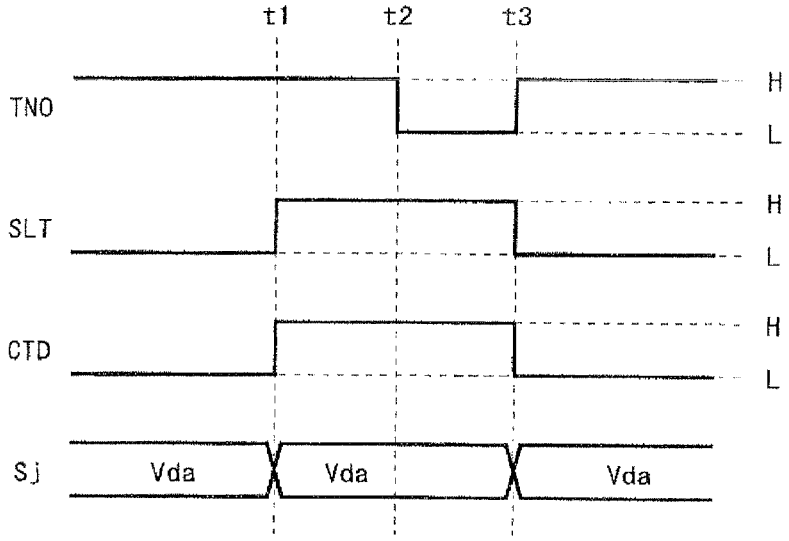
Fig. 9 Prior Art
FIG. 9 is a timing chart of the pixel circuit shown in FIG. 8.

Display devices of the present invention may include a pixel circuit shown in FIG. 7. A pixel circuit 250 shown in FIG. 7 is obtained by making changes to the pixel circuit 200 such that one terminal of a switching TFT 214 is connected to a control wiring line Wi and a power supply wiring line Vref is eliminated. By thus connecting a gate terminal of the switching TFT 214 to the same wiring line as another terminal thereof, the number of wiring lines is reduced by one, and the aperture ratio and yield of the display device can be increased.

Although in the above description the pixel circuit includes an organic EL element as an electro-optic element, the pixel circuit may include, as an electro-optic element, a current-driven type electro-optic element other than an organic EL element, such as a semiconductor LED (Light Emitting Diode) or a light-emitting portion of an FED.

In the above description, the pixel circuit includes, as a drive element for an electro-optic element, a TFT which is a MOS transistor (here, a silicon gate MOS structure is also referred to as a MOS transistor) formed on an insulating substrate such as a glass substrate. Instead of this, the pixel circuit may include, as a drive element for an electro-optic element, any voltage control type element whose output current changes according to a control voltage applied to a current control terminal, and which has a control voltage (threshold voltage) at which the output current is zero. Thus, for a drive element for an electro-optic element, for example, general insulated-gate field-effect transistors including MOS transistors formed on a semiconductor substrate, etc., can be used. By using an insulated-gate field-effect transistor as a drive element, when variations in the threshold voltage of the drive element are compensated for, a current flowing through the drive element can be prevented from flowing to an electro-optic element. By this, unnecessary light emission from the electro-optic element is prevented, whereby the contrast of a screen can be increased and deterioration of the electro-optic element can be suppressed.

Although in the above description the pixel circuit includes TFTs as switching elements, the pixel circuit may include, as switching elements, general insulated-gate field-effect transistors including MOS transistors formed on a semiconductor substrate, etc.

The present invention is not limited to the above-described embodiments and various changes may be made thereto. Embodiments obtained by appropriately combining technical means disclosed in the different embodiments are also included in the technical scope of the present invention.

INDUSTRIAL APPLICABILITY

Display devices of the present invention have the effects of a high light-emission duty ratio, not requiring patterning of one side of the electrodes of electro-optic elements, high display quality, and low cost, and thus, can be used as various types of display devices including current-driven type display elements, such as organic EL displays and FEDs.

The invention claimed is:

1. A method for driving a pixel circuit, a plurality of which are arranged on a current-driven type display device, at respective intersections of a plurality of scanning lines and a plurality of data lines, the method comprising the steps of:

when the pixel circuit includes: a drive element provided on a path connecting a first wiring line to a second wiring line, having a control terminal, a first terminal, and a second terminal, and controlling a current flowing through the path; an electro-optic element provided in series with the drive element on the path, being connected to the first terminal of the drive element, and emitting light at a luminance according to the current flowing through the path; a first switching element provided between the first terminal of the drive element and the data line; a second switching element provided between the control terminal and the second terminal of the drive element; a third switching element provided between the second terminal of the drive element and the first wiring line; and a capacitor provided between the control terminal of the drive element and one of a plurality of third wiring lines, controlling the first and second switching elements to a conducting state and the third switching element to a non-conducting state, and providing a potential which changes according to display data and at which a voltage applied to the electro-optic element is a light-emission threshold voltage or less, to the data line;

controlling potentials of the plurality of the third wiring lines; and controlling the first and second switching elements to a non-conducting state and the third switching element to a conducting state, wherein said controlling the potentials of the plurality of the third wiring lines comprises selecting one of the plurality of the third wiring lines, providing a first potential for non-light emitting to the selected wiring line to place the electro-optic element in a non-light emitting state when the first and second switching elements are controlled to a conducting state and the third switching element is controlled to a non-conducting state, providing a second potential for light emitting to the selected wiring line to place the electro-optic element in a light emitting state after the first and second switching elements are controlled to a non-conducting state, and continuously providing the second potential to the rest of the plurality of the third wiring lines.

2. The method for driving a pixel circuit according to claim 1, further comprising the step of:

when the pixel circuit further includes a fourth switching element provided between the control terminal of the drive element and a fourth wiring line, controlling the fourth switching element to a conducting state while the first and second switching elements are in a conducting state and the third switching element is in a non-conducting state, with a potential that places the drive element in a conducting state being provided to the fourth wiring line.

* * * * *